US009441894B1

(12) United States Patent
Moy

(10) Patent No.: US 9,441,894 B1
(45) Date of Patent: Sep. 13, 2016

(54) BLEEDING MECHANISM FOR USE IN A PROPULSION SYSTEM OF A RECOILLESS, INSENSITIVE MUNITION

(71) Applicant: Leon Moy, Montclair, NJ (US)

(72) Inventor: Leon Moy, Montclair, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 315 days.

(21) Appl. No.: 14/276,240

(22) Filed: May 13, 2014

(51) Int. Cl.
*F41A 1/08* (2006.01)

(52) U.S. Cl.
CPC ..... *F41A 1/08* (2013.01)

(58) Field of Classification Search
CPC ..... F41A 1/08; F41A 1/10
USPC ..... 89/1.7, 1.701–1.706; 102/437, 481
See application file for complete search history.

(56) References Cited

U.S. PATENT DOCUMENTS

| | | | | |
|---|---|---|---|---|
| 3,800,656 A * | 4/1974 | Schnabele | F41A 1/08 89/1.14 |
| 7,191,693 B2 * | 3/2007 | Ax | F41A 1/10 102/437 |
| 7,353,739 B2 * | 4/2008 | Ax | F41A 1/10 89/1.7 |
| 2005/0217468 A1 * | 10/2005 | Ax | F41A 1/10 89/1.704 |
| 2006/0249011 A1 * | 11/2006 | Ax | F41A 1/10 89/1.701 |

* cited by examiner

*Primary Examiner* — Jonathan C Weber
(74) *Attorney, Agent, or Firm* — Michael C. Sachs

(57) ABSTRACT

A bleeding mechanism for use in the propulsion system of a recoilless, insensitive munition utilizing a utilizing a fluidic countermass. The present bleeding mechanism utilizes a firing pin or a similar puncture or tear device. A heat sensitive material blocks the movement of the firing pin. A mechanical locking mechanism locks the firing pin in position until it is unlocked by the melting of the heat sensitive material. When the insensitive munition is exposed to heat, the reaction of the heat sensitive material within the bleeding mechanism allows the firing pin to be released and to rupture a cartridge seal. The cartridge may be filled with a compressed compound, which releases gas under pressure to the countermass container, causing a countermass cover to rupture, thereby emptying the countermass fluid.

20 Claims, 11 Drawing Sheets

BLEEDING MECHANISM FOR USE IN A PROPULSION SYSTEM OF A RECOILLESS, INSENSITIVE MUNITION

FEDERAL INTEREST STATEMENT

The inventions described herein may be manufactured, used and licensed by the United States Government for United States Government purposes without payment of any royalties thereon or therefore.

FIELD OF THE INVENTION

The present invention relates in general to the field of weaponry. In particular, the present invention relates to a bleeding mechanism for use in the propulsion system of a recoilless, insensitive munition utilizing a fluidic countermass.

BACKGROUND OF THE INVENTION

The U.S. Department of Defense is currently moving toward the long-term goal of insensitive munition-compliant inventory. The acquisition treatment of insensitive munitions was the subject of a Jan. 26, 1999, memorandum from the Under Secretary of Defense for Acquisition, Technology and Logistics. The overall intent of the memorandum was to focus scarce resources on forward fit incorporation of insensitive munition-compliant technology.

Insensitive munition is expected to save lives and materials. As defined in STANAG 4439, insensitive munitions mean: "Munitions which reliably fulfill their performance, readiness and operational requirements on demand, but which minimize the probability of inadvertent initiation and severity of subsequent collateral damage to weapon platforms, logistics systems and personnel when subjected to unplanned stimuli."

"Unplanned stimuli" include thermal and mechanical impact threats of Fast Cook-Off (FCO), Slow Cook-Off (SCO), Bullet Impact (BI), Fragment Impact (FI), Sympathetic Detonation (SD), Shaped Charge Jet (SCJ), and Spall impact (SI) as presented in MIL-STD-2105B.

The memorandum adds: "All munitions and weapons shall be designed to conform with insensitive munitions (unplanned stimuli) criteria and to use materials consistent with safety and interoperability requirements. Requirements shall be determined during the requirements validation process and shall be kept current throughout the acquisition cycle for all acquisition programs. Interoperability, to include insensitive munitions policies, shall be certified per CJCSI 3170.01 A." "The ultimate objective is to design and field munitions which have no adverse reaction to unplanned stimuli, analogous to Hazard Division 1.6 (TB 700-2/NAVSEAINST 8020.8B/T.O. 11A-1-47/DLAR 8220.1, "Department of Defense Ammunition and Explosives Hazard Classification Procedures")."

While prior efforts to develop an insensitive munition (IM) propulsion system for a recoilless weapon utilizing a countermass presented certain advantages, they still suffered from numerous shortcomings, amongst which are the following:

a. Recoilless weapons often utilize filament wound barrels in order to maximize strength and minimize weight. Because cutting holes in these barrels would compromise their integrity, the common practice of venting the propulsion system will not be feasible.

b. The utilization of heat sensitive materials to allow the countermass to drain will be difficult because the countermass behaves as a heat sink, preventing the heat sensitive materials from heating durng a cook off.

c. Other features located within the barrel relied on heat to activate, but the percussion cap located on the surface of the barrel is exposed to the heat much earlier than the in-barrel features.

d. Some of these features utilized eutectic alloys to solder mechanical components. While eutectic alloys have an excellent temperature response, the processes to solder these components lack an industrial base for full rate production. Additionally, the eutectic alloy is costly.

According to United States Code, Title 10, Chapter 141, Section 2389—Ensuring safety regarding Insensitive Munitions (IM)—the Secretary of Defense shall ensure, to the extent practicable, that munitions under development of procurement are safe throughout development and fielding when subject to unplanned stimuli.

Two tests are used to simulate munitions exposed to a fire: Slow Cook Off (SCO) and Fast Cook Off (FCC). In SCO, munitions in packaged configuration are heated at a rate of 6° C./hour until it reacts. In FCC, munitions are engulfed in a flame of at least 1700° C. until it reacts. It is desirable for the reaction to be limited to no more than burning (Type 5 reaction). A detonation is not acceptable (Type 1 reaction).

Recoilless weapons operate by using expanding propellant gases to propel a projectile forward and a mass backwards in order to minimize recoil. Some recoilless weapons utilize a fluid as a countermass, which is propelled backwards in order to minimize the hazard of the back blast to allow for firing from enclosure.

When tested for IM, the propulsion systems of the recoilless weapons sometimes ignite, launching the projectile, which fails IM requirements with a Type 4 deflagration. The warhead may become armed and detonate, which fails IM with a Type 1 detonation. It has been found that the removal of the countermass will often prevent the projectile from leaving the barrel and arming.

It would therefore be desirable to provide a bleeding mechanism for use in the propulsion system of a recoilless, insensitive munition (IM) utilizing a utilizing a fluidic countermass that addresses the foregoing problems associated with convention IM systems. The bleeding mechanism would be activated by excess heat, and as a result, it would cause the countermass container to rupture. Once ruptured, the countermass fluid will drain out. Without a countermass, the propulsion system will no longer function. The need for such a bleeding mechanism has heretofore remained unsatisfied.

SUMMARY OF THE INVENTION

The present invention satisfies this need and describes a novel bleeding mechanism for use in the propulsion system of a recoilless, insensitive munition (IM) utilizing a utilizing a fluidic countermass.

According to a preferred embodiment, the present bleeding mechanism utilizes a firing pin or a similar device which is held in place by any one or more of:

a. A heat sensitive material that bonds to a firing pin.

b. A heat sensitive material that blocks the movement of the firing pin.

c. A mechanical device that locks the firing pin in position until a heat sensitive material unlocks the device.

The insensitive munition generally includes a tubular barrel within which a projectile (or warhead) is housed. A propulsion system and a liquid filled countermass container are also housed within the barrel, behind the projectile.

The present bleeding mechanism can either form part of the insensitive munition, or it can be externally and separately connected to the insensitive munition. In either design, the bleeding mechanism is connected to an inlet of the countermass container.

When the insensitive munition is exposed to an unplanned stimulus, such as heat, the reaction of a heat sensitive material within the bleeding mechanism allows a firing pin to be released and to rupture a cartridge seal. The cartridge may be filled with a compressed gas or a compound that releases gas when exposed to heat. The released gas may be any suitable gas such as carbon dioxide, nitrogen, and helium. The compound may be a material that outgases when heated, such as sodium bicarbonate, potassium carbonate, and potassium bicarbonate, or an energetic material that combusts to generate gas.

The compressed gas from the cartridge will flow into the countermass container and may:

a. Rupture the container, allowing or forcing the fluid out of the countermass container.
b. Force the fluid within the countermass container to travel to either:
   i. the propulsion system in order to achieve a Type 6, no reaction; or
   ii. the warhead to assist in an IM feature used to improve the warhead IM performance.

With the fluid removed from the countermass container, if the propulsion system activates, the projectile will remain within the insensitive munition.

If the bleeding mechanism is located outside the barrel it will be readily exposed to the heat of a cook off. The filament wound barrel of the weapon is a good insulator and restricts the flow of heat to the heat sensitive device. The positioning of the device outside the weapon allows it to react to the thermal stimuli in a timely manner.

More specifically, the present bleeding mechanism utilizes a heat sensitive material that may include any one or more of the following designs:

a. Low melting temperature materials including but not limited to alloys, ionomer plastics, waxes, or salts.
b. Low boiling temperature materials in an ampoule.
c. Shape memory materials that deform, unlocking the locking mechanism.
d. Reactive materials initiated by heat.
e. Commercially available indium, bismuth, lead, and tin-based alloys.
f. Commercially available plastics, such as polyethylene and ionomers.
g. Waxes.
h. Soluble salts used inside ballistic material to provide cooling during a cook off. Reference is made to the following web site: http://www.rockyresearch.com/news/RR_News_Archives_022411. pdf
i. Alcohol filled ampoules used in automatic fire sprinkler heads.
j. Shape Memory alloys and shape memory composites.
k. Slow burning propellant (base bleed material), slow burning pyrotechnics.

BRIEF DESCRIPTION OF THE DRAWINGS

The above and other features of the present invention and the manner of attaining them, will become apparent, and the invention itself will be best understood, by reference to the following description and the accompanying drawings:

FIG. 3 is comprised of FIGS. 3A and 3B, wherein

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
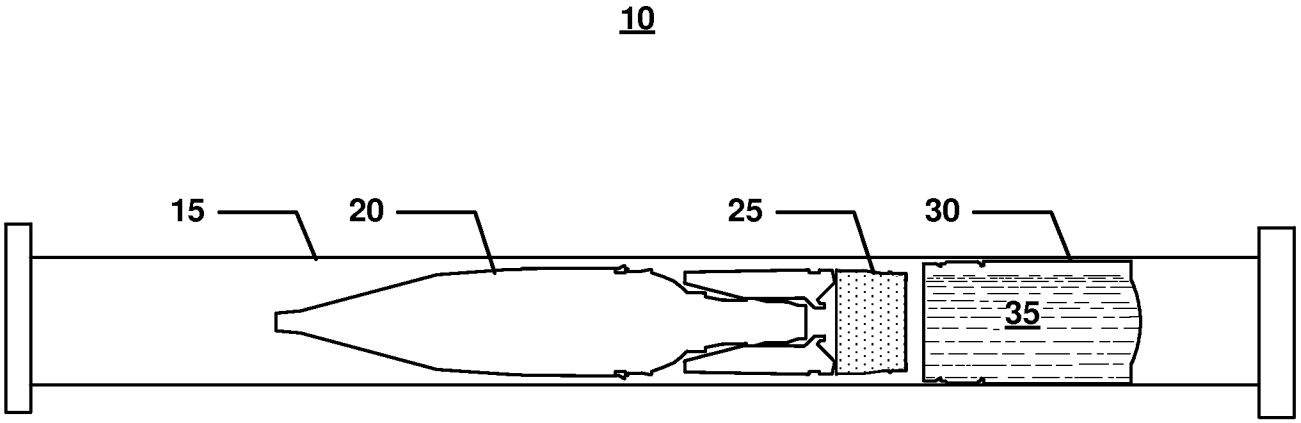
(PRIOR ART) FIG. 1
FIG. 1 is a representation of a conventional recoilless, insensitive munition.

FIG. 1 is a representation of a conventional recoilless, insensitive munition 10 having a tubular barrel or launch tube 15. A warhead or projectile 20 is placed within the launch tube 15. A propulsion system 25 and a liquid filled countermass container 30 are also housed within the launch tube 15, behind the projectile 20.

Since the insensitive munition 10 often utilizes a filament wound barrel 15 in order to maximize strength and minimize weight, cutting holes in the barrel 15 to allow the countermass 35, within the countermass container 30, will compromise the integrity of the insensitive munition 10, and is therefore neither feasible nor recommended.

Figure 2:
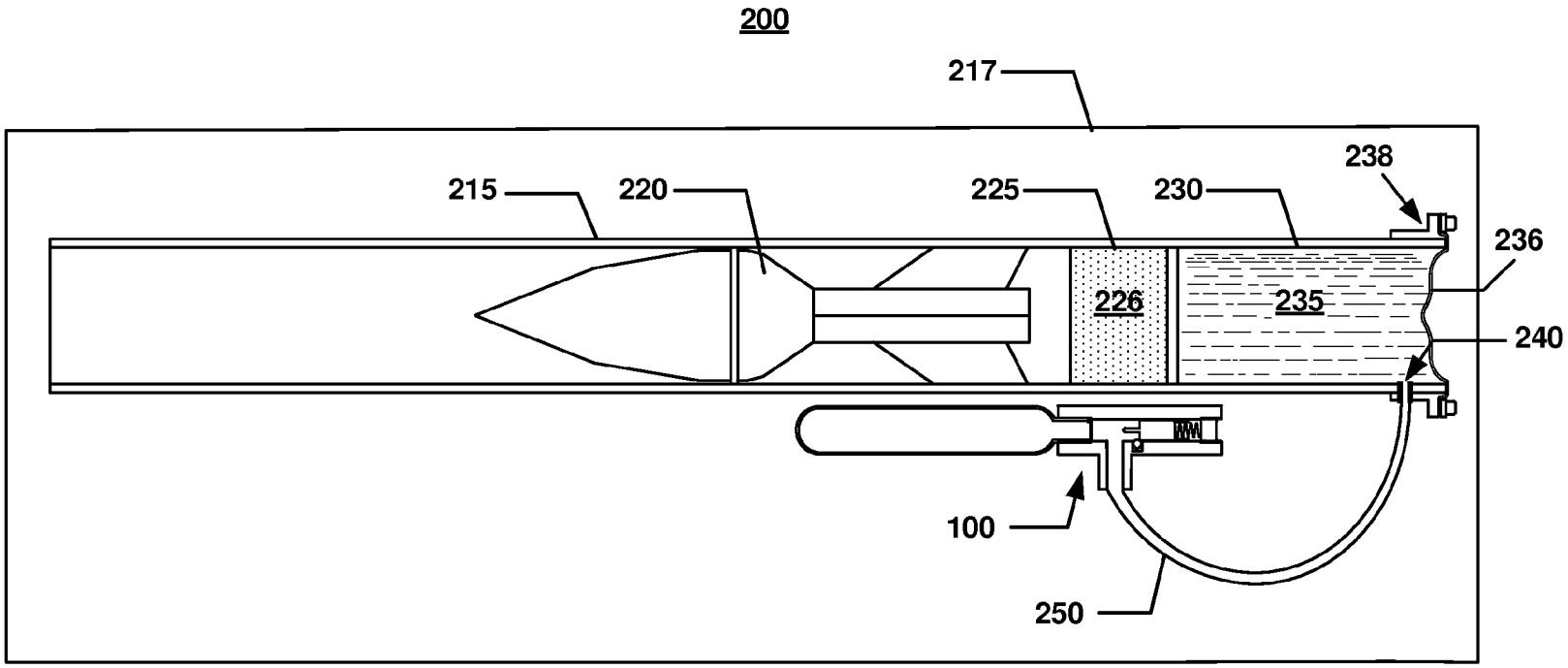
FIG. 2 is a representation of an insensitive munition that is provided with a bleeding mechanism according to a preferred embodiment of the present invention.

Wherefore, the present invention generally describes a novel bleeding mechanism 100 for use as an external auxiliary to an insensitive munition 200, for example as part of a storage unit or container 217, as illustrated in FIG. 2. Since the bleeding mechanism 100 is located externally relative to the barrel 215, it is not shielded from the heat of the cook off.

Alternatively, the bleeding mechanism 100 can form an integral part of the insensitive munition 200, and could be secured externally, to a barrel 215, or it could be placed internally relative to the barrel 215 of the insensitive munition 200.

The recoilless insensitive munition 200 further includes a projectile 220, a propulsion system 225 that contains a propellant 226, and a countermass container 230 that contains a fluidic countermass 235.

The countermass container 230 is generally cylindrically shaped and is open at one end thereof. When the countermass container 230 is filled with the fluidic countermass 235, its open end is sealed with an elastic countermass cover 236. The countermass cover 236 is secured to the barrel 215 by means of a countermass cover retention feature 238 that is either known or available, and thus it will not be described in detail.

The countermass cover 236 is preferably made of elastomeric material, such as Polyethylene, in order to allow for expansion under pressure. The fluidic countermass 235 is preferably a saline solution, but could be any other suitable solution, including but not limited to Iron oxide solution, plastic confetti.

The countermass container 230 also includes a compressed gas inlet 240 that is connected to an inlet tube 250, for allowing the compressed air to enter, through the inlet 240 to the countermass container 230, via the inlet tube 250, as it will be explained later in greater detail. The inlet tube 250 forms part of the bleeding mechanism 100.

Figure 3A:
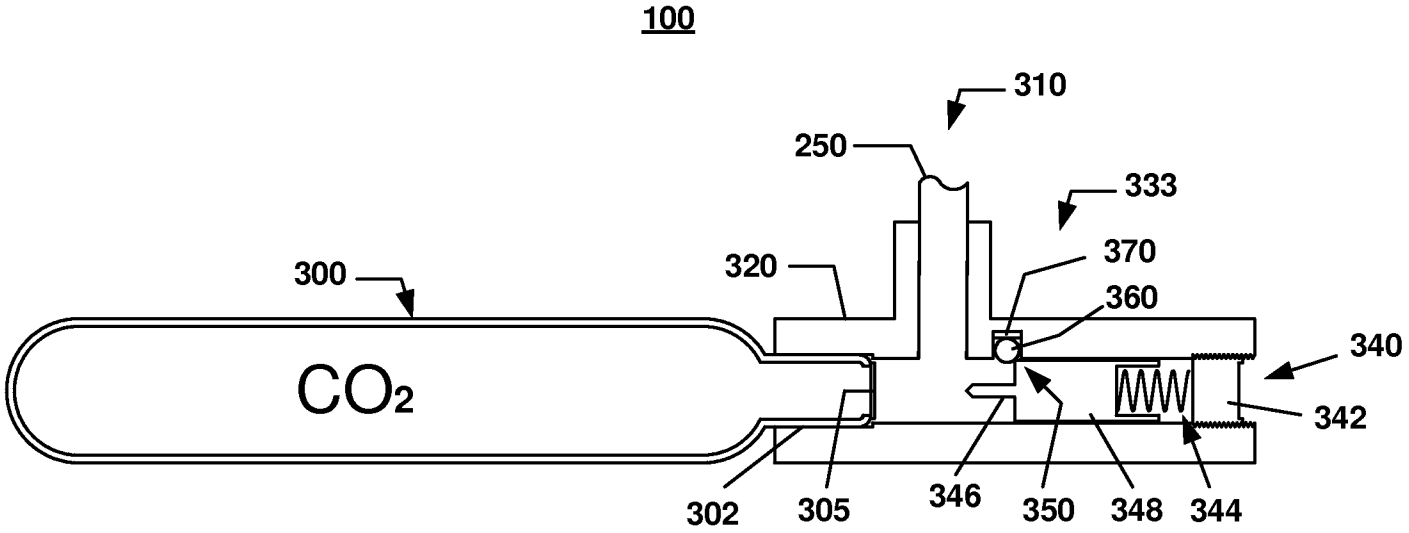
FIG. 3A is an enlarged representation of the bleeding mechanism of FIG. 2, shown in a deactivated state.
Figure 3B:
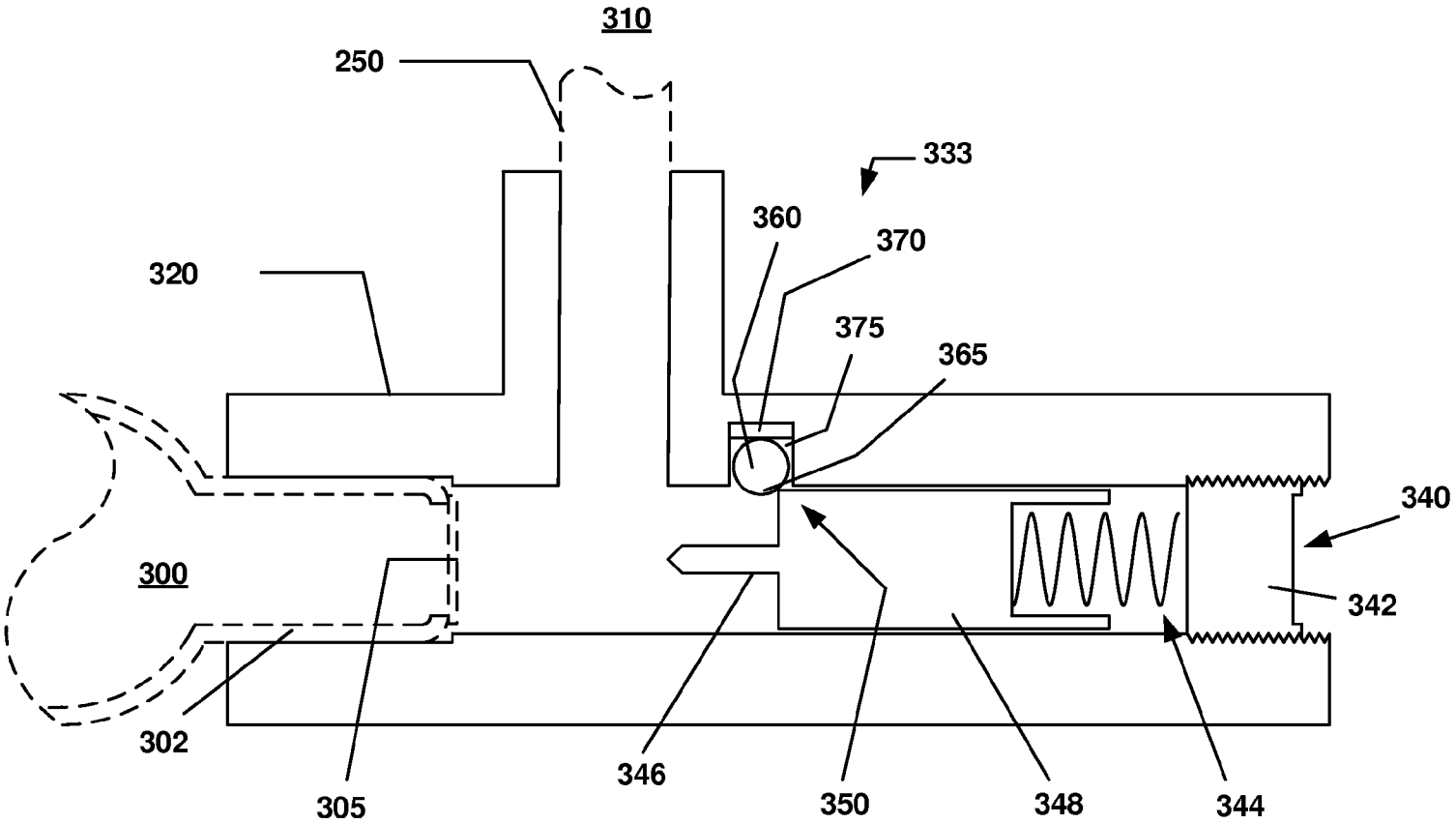
FIG. 3B is a greatly enlarged view of a bleeding controller that forms part of the bleeding mechanism of FIG. 3A.

FIGS. 3A and 3B illustrate the bleeding mechanism 100 of FIG. 2, shown in a deactivated state. The bleeding mechanism 100 generally includes a source of pressurized fluid, such as a cylinder or a canister 300 of pressurized carbon dioxide, $CO_2$. The cylinder 300 includes a neck 302 that is hermetically sealed with a seal 305. In this state, the seal 305 is still unruptured and maintains pressure within the cylinder 300.

The bleeding mechanism 100 further includes a bleeding controller 310 that controls the flow of the gas to the countermass container 230, as illustrated in FIGS. 2, 5, 6, and 7. The bleeding controller 310 generally includes a generally cylindrically shaped bleeding chamber 320 that retains the neck 302 of the cylinder 300 at one of its ends. The bleeding chamber 310 further retains the tube 250, and provides a path for the gas that escapes from the cylinder 300.

The opposite end of the bleeding controller 310 houses a slidable firing pin assembly 340. The firing pin assembly 340 includes a firing pin 346 that protrudes axially, in the direction of the seal 305, within the bleeding chamber 310. The firing pin assembly 340 further includes a support body 348 that supports the firing pin 346, and that is capable of sliding axially toward the seal 305, as it will be explained in connection with FIG. 4.

Under normal conditions, that is in the absence of an unplanned stimulus, the support body 348 compresses a spring 344 against a base 342. This compression state is maintained by means of a locking mechanism 333, as long as the thermal and other conditions remain within predefined normal parameters.

According to this preferred embodiment, the locking mechanism 333 includes a The locking feature such as a ball, and a heat sensitive alloy 370. In this compression state, the heat sensitive alloy 370 is placed within a crevice, indentation, or deformation 375 within the inner surface of the bleeding chamber 320. The locking ball 360 is placed against the alloy 370 and retains it in place.

The heat sensitive material 370 can be a low melting point eutectic solder, such as an Indium/tin alloy. Since a small amount of the eutectic solder (or alloy) is needed, the cost of the locking mechanism 333 will not be significantly affected. The eutectic alloy 370 has an ideal thermal response to heat, melting completely at a precise temperature. The present invention utilizes the eutectic alloy 370 as a secondary feature in the locking mechanism 333, allowing the higher mechanical properties of the steel ball 360 to hold back the firing pin 346.

The locking ball 360 is preferably spherically shaped. The locking ball 360 can be made of any suitable material, including but not limited to stainless steel. The crevice 375 is shaped and dimensioned so that in the compressed state, as it accommodates the unmelted alloy 370, a portion 365 of the locking ball 360 protrudes outwardly from the crevice 375, so as to engage an edge 350 of the support body 348. As a result, the locking mechanism 333 retains the firing pin assembly 340 in a locked position, with the spring 344 compressed against the base 342.

Figure 4:
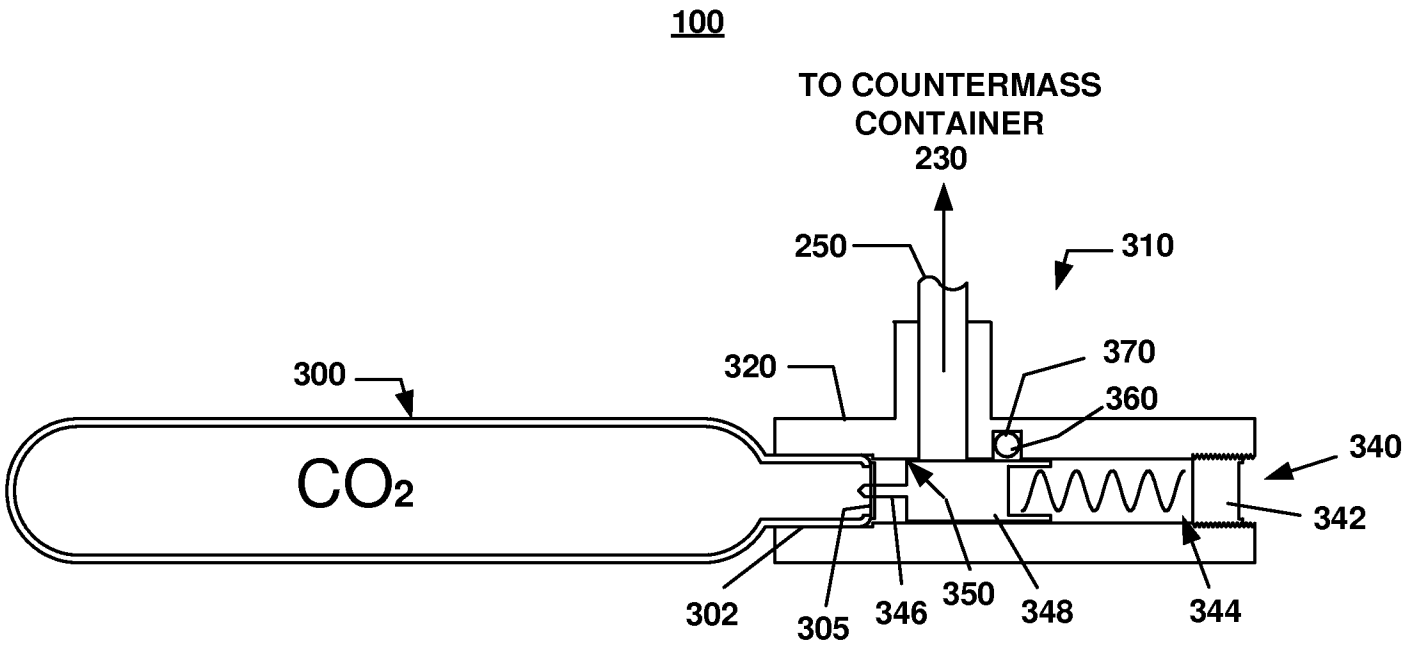
FIG. 4 is an enlarged representation of the bleeding mechanism of FIGS. 2 and 3, shown in an activated state.

Referring now to FIG. 4, it illustrates the bleeding mechanism 100 in an activated state. If and when the environmental conditions change, that is when the insensitive munition 200 is exposed to an unplanned stimulus, for example, if the thermal conditions surrounding the insensitive 200 change, such as when the heat sensitive alloy 370 is exposed to elevated temperatures, for example, approximately 250° F., then the heat sensitive alloy 370 melts, causing the locking ball 360 to recede within the crevice 375. The recession of the locking ball 360 unlocks the locking mechanism 333 by releasing the edge 350 of the support body 348 from the wedging of the ball 360, and causes the spring 344 to expand, forcing the support body 348 and the firing pin 346 forward toward the seal 305, rupturing it.

As the seal 305 is ruptured, the pressurized gas within the cylinder 300 expands and escapes, through the ruptured seal 305, the bleeding chamber 320, and the tube 250, to the countermass container 230.

Figure 6:
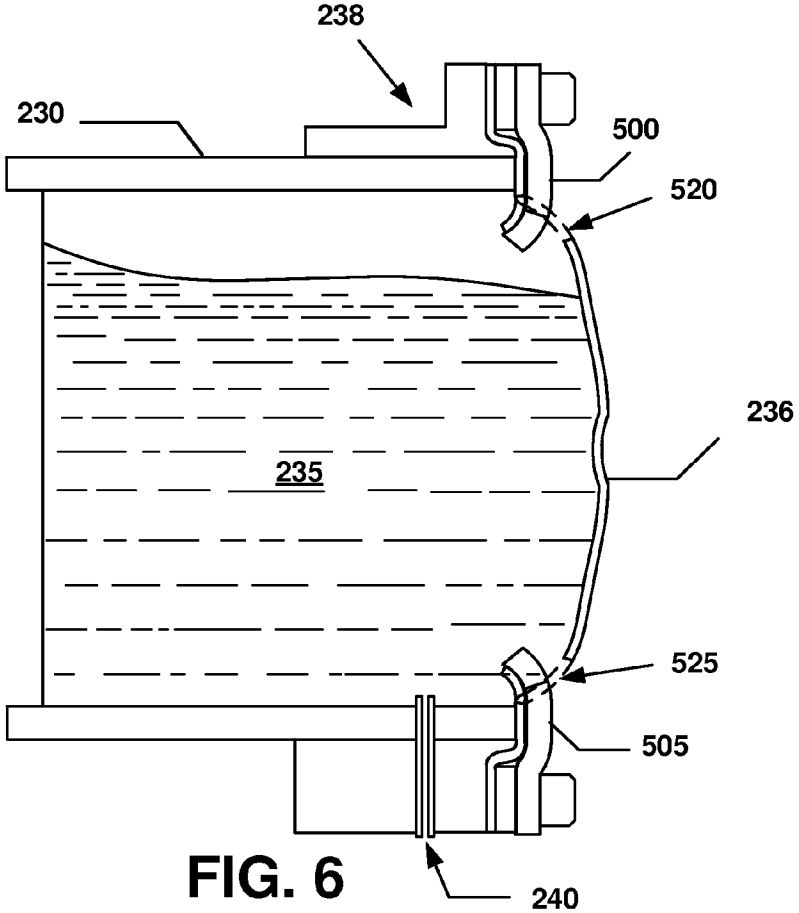
FIGS. 5, 6, 7 are representations of a first embodiment of a countermass container forming part of the insensitive munition of FIG. 2, illustrating progressive stages before and after the bleeding mechanism of FIG. 4 is activated.
Figure 5:
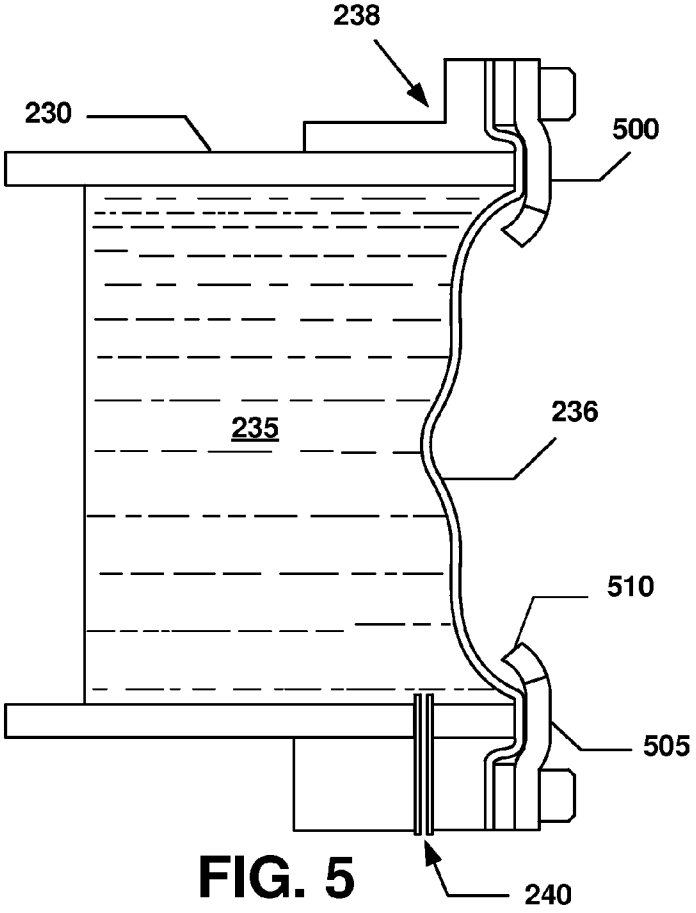
Figure 7:
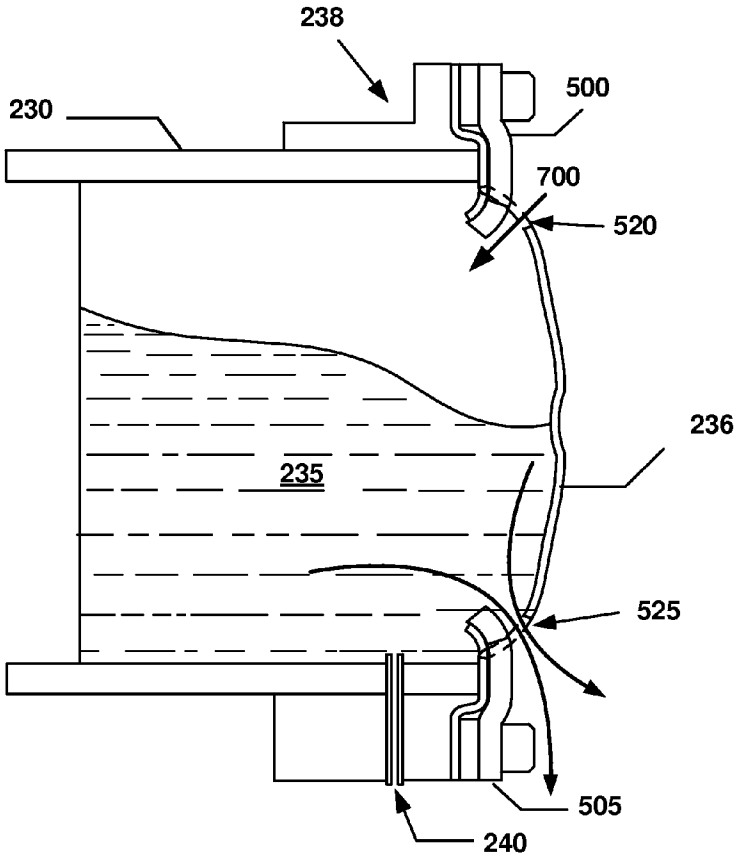

FIGS. 5, 6, and 7 the progressive stages of the countermass container 230 before and after the bleeding mechanism 100 has been activated.

FIG. 5 illustrates the countermass container 230 when the bleeding mechanism 100 has not been activated (FIGS. 2, 3A, 3B). In this particular preferred embodiment, the countermass container 230 is provided with one or more openers 500, 505, that are retained by the countermass cover retention feature 238. Each of the openers 500, 505 has a sharp edge 510 that is positioned in close proximity to the countermass cover 236, along the periphery of the countermass container 230.

When the bleeding mechanism 100 is not been activated, the countermass cover 236 is in a "deflated" or undeployed state, and the sharp edge 510 of the openers 500, 505, remains at a safe distance from the countermass cover 236 so as not to puncture it.

FIGS. 6 and 7 illustrate the countermass container 230 when the bleeding mechanism 100 has been activated (FIG. 4). As the gas from the cylinder 300 is injected into the countermass container 230 under pressure, it causes the countermass cover 236 to be deployed and to be ruptured by the openers 500, 505, at one or a plurality of ruptures or tears 520, 525, respectively.

As more clearly illustrated in FIG. 7, input air 700, at atmospheric pressure enters the countermass container 236 through the rupture 520, and further forces the fluid countermass 235 to drain through the rupture 525, until the countermass container 230 is emptied of its fluid content 235. Consequently, the propulsion system 226 will be disabled.

Figure 9:
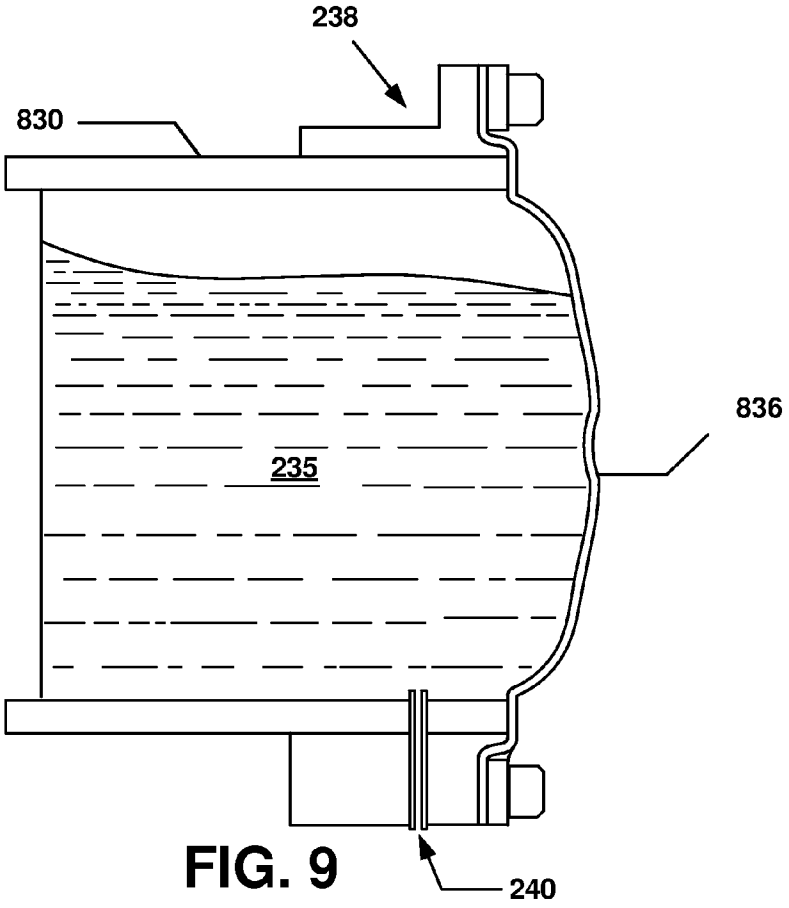
FIGS. 8, 9, 10 are representations of a second embodiment of the countermass container of the insensitive munition of FIG. 2, illustrating progressive states before and after the bleeding mechanism of FIG. 4 is activated.
Figure 8:
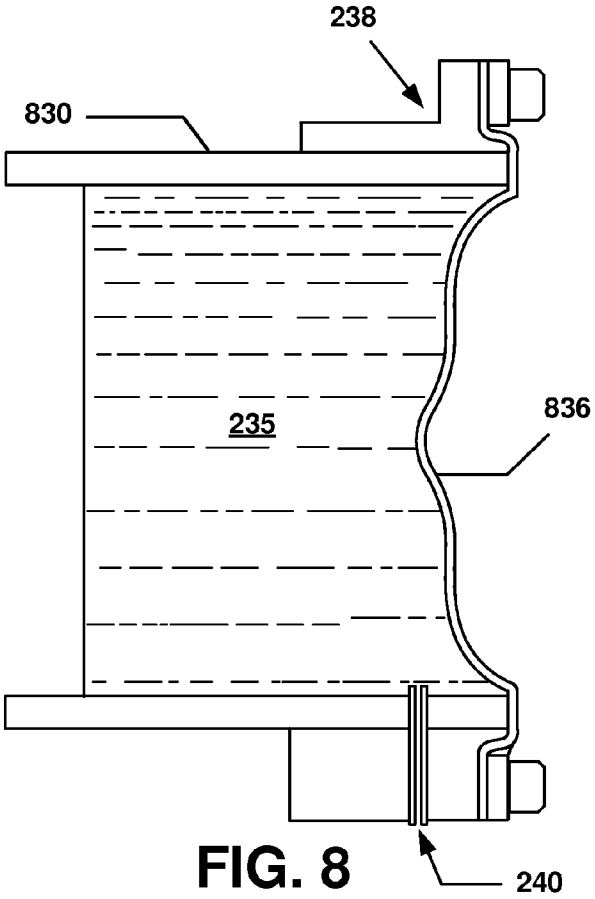
Figure 10:
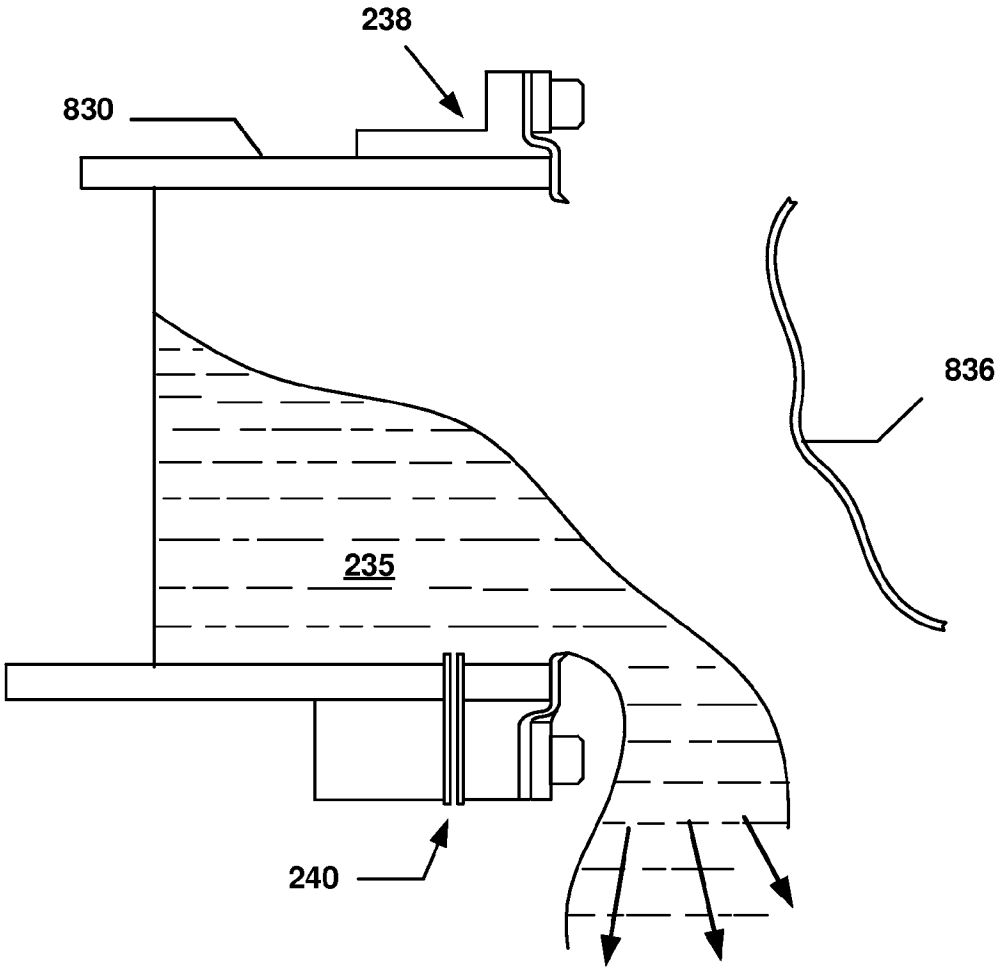

FIGS. 8, 9, and 10 illustrate another embodiment of the countermass container of the insensitive munition of FIG. 2, showing progressive states after the bleeding mechanism 100 of FIG. 4 has been activated. The countermass container 830 of FIGS. 8, 9, and 10 is similar in design, construction, and operation to the countermass container 230 of FIGS. 5, 6, and 7, with the exception that the countermass container 830 does not include the opener 500, 505 of FIGS. 5, 6, and 7.

Rather, the countermass cover 836 of the countermass container 830 is made of a readily rupturable material, such as for example, polyethylene, that ruptures when the countermass cover 836 is deployed under pressure from the injected gas, as explained earlier.

Figure 11:
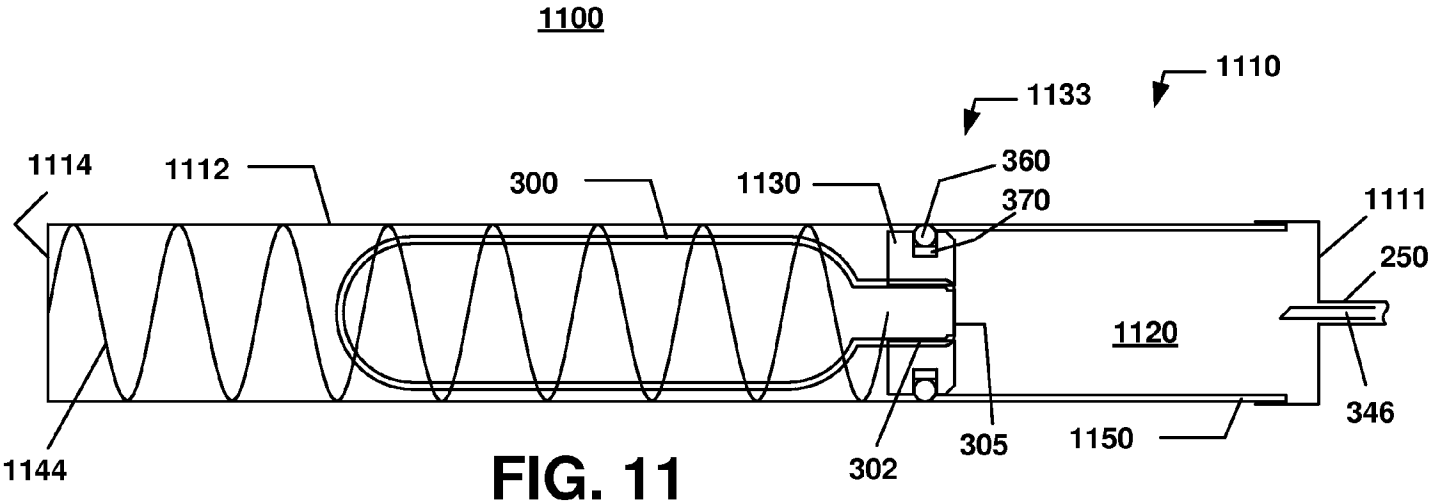
FIG. 11 is a representation of another embodiment of the bleeding mechanism of FIG. 2, shown in a deactivated state.

FIG. 11 illustrates another bleeding mechanism 1100, shown in a deactivated state. The bleeding mechanism 1100 includes a bleeding controller 1110 that controls the flow of the gas to the countermass container 230. The bleeding controller 1110 generally includes a generally cylindrically shaped bleeding chamber 1120 and a sliding assembly 1130.

The sliding assembly 1130 retains the neck 302 of the cylinder 300 in a slidable relationship relative to the housing 1112. The bleeding chamber 310 provides a path for the gas that escapes from the cylinder 300.

In this embodiment, the firing pin 346 is secured to a fixed structure 1111, and the pressurized gas cylinder 300 is retained in a spring loaded position, against a housing 1112.

To this end, the body of the cylinder 3300 is surrounded by a spring 1144 that is compressed against the bottom side 1114. This compressed position is maintained by means of a locking mechanism 1133 that is similar in function to that of the locking mechanism 333.

The locking mechanism 1133 includes a sliding assembly 1130 that surrounds, and that is tightly secured to the neck 302 of the cylinder 300. The sliding assembly 1130 includes an indentation within which the heat sensitive alloy 370 is housed. The locking ball 360 is inserted within the indentation, atop the heat sensitive alloy 370, such that a portion of the locking ball 360 protrudes from the indentation.

The protruding portion of the locking ball 360 engages a sleeve 1150 that is affixed to the housing 1112. As a result, the engagement of the sleeve 1150 and the locking ball 360 retains the spring in a compressed position, holding the cylinder 300 at a distance from the firing pin 346.

Figure 12:
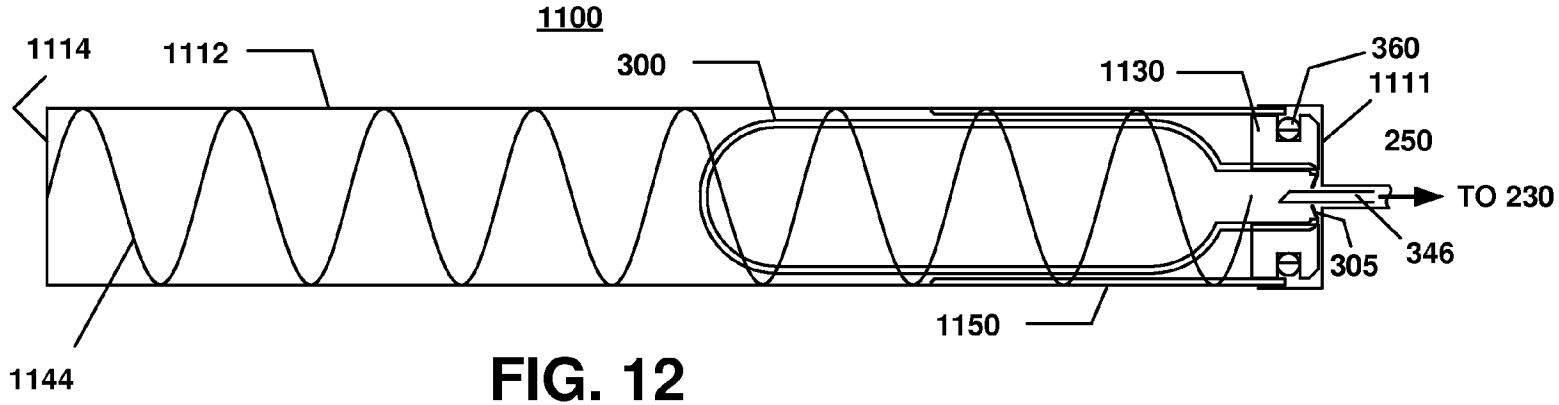
FIG. 12 is a representation of the bleeding mechanism of FIG. 11, shown in an activated state.

FIG. 12 is a representation of the bleeding mechanism 1100 of FIG. 11, shown in an activated state. As explained earlier, when the insensitive munition 200 is exposed to excessive heat, the heat sensitive alloy 370 melts, causing the locking ball 360 to be depressed within the indentation of the sliding assembly 1130.

In turn, the sleeve 1150 disengages from the locking bail 360, which allows the sliding assembly 1130, along with the cylinder 300 to be propelled forward toward the firing pin 346. As a result, the firing pin 346 punctures the seal 305 of the cylinder 300, resulting in the escape of the gas from within the cylinder 300 to the countermass container 230, through the tube 250, as described earlier.

Figure 13:
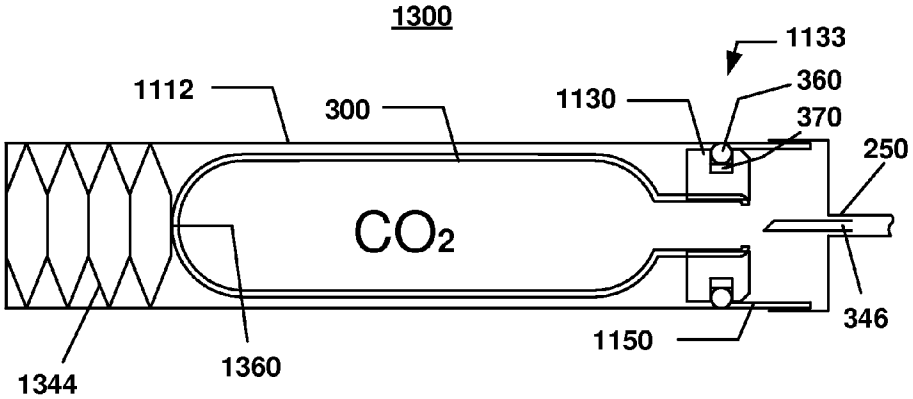
FIG. 13 is a representation of yet another embodiment of the bleeding mechanism of FIG. 2, shown in a deactivated state.
Figure 14:
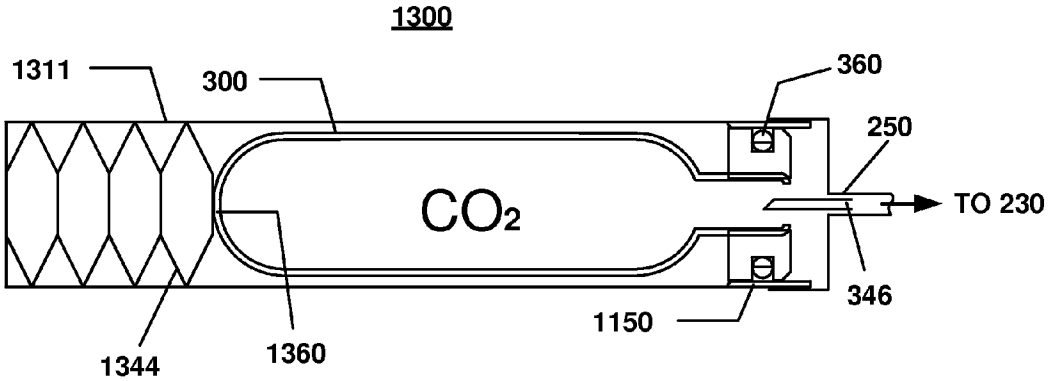
FIG. 14 is a representation of the bleeding mechanism of FIG. 13, shown in an activated state.

FIGS. 13, 14 illustrate another bleeding mechanism 1300 that is similar in design, construction, and operation to the bleeding mechanism 1100 of FIGS. 11, 12, with the single exception that it uses a different type of spring. The bleeding mechanism 1300 uses a Bellville type spring 1344 that engages the bottom 1360 of the cylinder 300. The stacked Bellville (disc) spring 1344 provides high force in a compact form.

It should be understood that other modifications might be made to the present bleeding mechanism 100 without departing from the spirit and scope of the invention. For example, the present invention may be applied to single use recoilless rifles utilizing a liquid countermass, and for the IAM (Individual Assault Munition).

Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both chemical and functional equivalents thereof. Additionally, it is intended that such equivalents include both currently known equivalents as well as equivalents developed in the future, i.e., any elements developed that perform the same function, regardless of composition.

What is claimed is:

1. A bleeding mechanism for use with an insensitive munition utilizing a fluidic countermass within a countermass container, the bleeding mechanism comprising:

a canister having a seal and filled with a gas under pressure;

a bleeding controller that is fluidly connected to the canister and to the countermass container;

wherein one end of the countermass container is sealed with a countermass cover; and wherein when the bleeding controller is exposed to an unplanned stimulus, the bleeding controller ruptures the seal of the canister, causing the gas within the canister to be released to the countermass container, resulting in the rupture of the countermass cover, and allowing the fluidic countermass to be drained from the countermass container in order to deactivate the insensitive munition.

2. The bleeding mechanism of claim 1, wherein the gas under pressure in the canister is selected from a group consisting essentially of: carbon dioxide, a non-flammable, and a non-hazardous gas.

3. The bleeding mechanism of claim 1, wherein the canister seal is made of a material that is selected from a group consisting essentially of: polyethylene, a plastic material, a metal, a composite, and glass.

4. The bleeding mechanism of claim 1, wherein the bleeding controller includes a bleeding chamber that retains a part of the canister, and that provides an escape path for the gas that is released from the canister.

5. The bleeding mechanism of claim 4, wherein the bleeding chamber further retains one end of a conduit; and wherein the other end of the conduit extends, and is secured to the countermass container, for extending the gas escape path from the bleeding chamber to the countermass container.

6. The bleeding mechanism of claim 4, wherein the bleeding controller further includes a locking mechanism and a firing pin assembly; and wherein if the bleeding controller is not exposed to the unplanned stimulus, the locking mechanism locks the firing pin assembly in position at a safe distance from the canister seal.

7. The bleeding mechanism of claim 6, wherein if the bleeding controller is exposed to the unplanned stimulus, the locking mechanism unlocks the pin assembly, causing the firing pin assembly to puncture the canister seal.

8. The bleeding mechanism of claim 7, wherein the bleeding chamber includes an indentation within an inner wall; and wherein the locking mechanism includes a heat sensitive material that is housed within the indentation, and a locking feature that is seated atop the heat sensitive material, and that is housed in part within the indentation.

9. The bleeding mechanism of claim 8, an exposed part of the locking feature engages the firing pin assembly for locking the firing pin assembly in position.

10. The bleeding mechanism of claim 9, wherein when the bleeding controller is exposed to the unplanned stimulus, the heat sensitive material melts, causing the locking feature to disengage from the firing pin assembly, and further causing the firing pin assembly to propel toward and to puncture the canister seal.

11. The bleeding mechanism of claim 8, wherein the locking feature includes a locking ball.

12. The bleeding mechanism of claim 6, wherein the firing pin assembly includes a slidable firing pin and an elastic element.

13. The bleeding mechanism of claim 12, wherein the elastic element includes a spring.

14. The bleeding mechanism of claim 1, wherein the bleeding controller includes a bleeding chamber, a sliding assembly, and a firing pin.

15. The bleeding mechanism of claim 14, wherein the sliding assembly retains a part of the cylinder; and wherein the bleeding chamber provides a path for the gas that escapes from the canister.

16. The bleeding mechanism of claim 15, wherein the bleeding controller further includes a sleeve that is secured to a housing, intermediate the sliding assembly and the firing pin.

17. The bleeding mechanism of claim 16, wherein if the bleeding controller is exposed to the unplanned stimulus, the locking mechanism unlocks the sliding assembly, causing the firing pin assembly to puncture the canister seal.

18. The bleeding mechanism of claim 1, wherein the unplanned stimulus includes any one or more of: excess thermal or mechanical impact threats of Fast Cook-Off (FCO) and Slow Cook-Off (SCO).

19. A bleeding mechanism for use with an insensitive munition utilizing a fluidic countermass within a countermass container, the bleeding mechanism comprising:

a canister having a seal and containing a gas generating compound;

a bleeding controller that is fluidly connected to the canister and to the countermass container;

wherein one end of the countermass container is sealed with a countermass cover;

wherein when the bleeding controller is exposed to an unplanned stimulus, the bleeding controller ruptures the seal of the canister, causing the gas generating compound to generate gas within the canister; and wherein the generated gas is released to the countermass container, resulting in the rupture of the countermass cover, and allowing the fluidic countermass to be drained from the countermass container in order to deactivate the insensitive munition.

20. The bleeding mechanism of claim 19, wherein the generated gas is selected from a group consisting essentially of: carbon dioxide, a non-flammable, and a non-hazardous gas.

* * * * *